US006257991B1

(12) United States Patent
Ortiz

(10) Patent No.: US 6,257,991 B1
(45) **Date of Patent: *Jul. 10, 2001**

(54) METAL CLUBHEAD AND DRIVER

(75) Inventor: Jesse J. Ortiz, Hillsborough, CA (US)

(73) Assignee: Orlimar Golf Co., Hayward, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/791,099

(22) Filed: Nov. 8, 1996

(51) Int. Cl.[7] ..... A63B 53/02; A63B 53/04

(52) U.S. Cl. ..... 473/309; 473/310; 473/328; 473/345

(58) Field of Search ..... 473/305–315, 473/324, 219, 328, 345, 346; D21/733

(56) References Cited

U.S. PATENT DOCUMENTS

| | | | | |
|---|---|---|---|---|
| D. 247,922 | * | 5/1978 | Sheldon | 473/328 |
| 1,787,415 | * | 12/1930 | Washington | 473/312 |
| 2,880,002 | * | 3/1959 | Wetty | 473/349 |
| 3,997,170 | * | 12/1976 | Goldberg . | |
| 4,065,133 | * | 12/1977 | Gordos . | |
| 4,432,549 | * | 2/1984 | Zebelean . | |
| 4,438,931 | * | 3/1984 | Motomiya . | |
| 5,094,383 | * | 3/1992 | Anderon . | |
| 5,203,565 | * | 4/1993 | Murray . | |
| 5,232,224 | * | 8/1993 | Zeider | 473/345 |
| 5,335,909 | * | 8/1994 | Green | 473/305 |
| 5,435,558 | * | 7/1995 | Iriarte . | |
| 5,441,263 | * | 8/1995 | Gorman . | |
| 5,456,469 | * | 10/1995 | MacDougall . | |
| 5,547,427 | * | 8/1996 | Rigal et al. | 473/346 |
| 5,720,674 | * | 2/1998 | Galy . | |
| 5,735,754 | * | 4/1998 | Antonious . | |

FOREIGN PATENT DOCUMENTS

| | | | | |
|---|---|---|---|---|
| 371665 | * | 4/1932 | (GB) | 273/80.3 |

OTHER PUBLICATIONS

Apr. 1992, brochure, title Orlimar Handcrafted Distinction (brochure, 7 pages (including front and rear covers)). See entire brochure, especially pages 1 and 3.

* cited by examiner

*Primary Examiner*—Sebastiano Passaniti
*Assistant Examiner*—Stephen L. Blau
(74) *Attorney, Agent, or Firm*—Philip A. Dalton

(57) ABSTRACT

A metal driver golf clubhead comprises a first member comprising the sole, toe, heel and rear of the clubhead; a second member comprising the face of the clubhead and joined to the first member along a generally vertically plane behind the face; and at least a pair of elongated grooves extending in the rear-to-front along the sole of the first member, terminating at the leading edge of the sole for reducing drag in the sole area. The runners which extend to the leading edge reduce the area which strikes the ground and allows the club to release from the initial dig into the turf. The hosel has an internal bore into which the golf club shaft is inserted and mounted, and a reverse tapered surface for securing the hosel and the club shaft in a mating bore in the clubhead. This increases the weight in the head, increases resistance to twist/torque, and imparts a more solid feel, including during the striking of a ball.

6 Claims, 2 Drawing Sheets

METAL CLUBHEAD AND DRIVER

I. BACKGROUND OF THE INVENTION

A. Field of the Invention

The present invention relates to golf clubs and, in particular, to metal drivers.

B. Definition of Term(s) and Discussion of Existing Technology

As used here "drivers" refers to golf clubs traditionally called "woods" and includes metal embodiments of such clubs, that is, metal woods or metal drivers.

The clubheads of prior art metal woods or drivers typically comprise two sections which are joined or welded along a generally horizontal plane above the sole.

II. SUMMARY OF THE INVENTION

In one aspect, the present invention is embodied in a metal driver golf club, in which the clubhead comprises a first body or member which itself comprises the sole, heel, toe and rear of the clubhead; and a second body or member which comprises the face of the clubhead. The two members are joined, for example, by a weld along a generally vertical joining line which is located at the periphery of the face of the clubhead and is coincident with the leading edge of the sole.

In a preferred embodiment, the hosel comprises a tube or shaft having opposite ends and having an internal bore into which the golf club shaft is inserted and mounted. At least the upper section of the hosel is enlarged, and has a reverse taper. The clubhead has a mating reverse tapered bore in which the hosel is mounted. The hosel and the associated golf club shaft are joined to the clubhead, by inserting or injecting a joining medium such as epoxy into the bore along with the hosel and shaft.

In another preferred aspect, the hosel has a stepped configuration. At a point between the two opposite ends, the tube expands via a shoulder to an enlarged cross-section which decreases toward the outer (upper) end of the hosel. The mating body bore comprises a relatively small cross-section, lower section which corresponds to the relatively small cross-section, lower section of the hosel, and a relatively large cross-section, reverse taper upper section, which corresponds to the relatively large cross-section, upper section of the hosel. The diameter of the bore is approximately the same dimension as or slightly larger than the diameter of the corresponding sections of the hosel. The relatively wide lower end of the tapered section of the hosel is countersunk within and captured by the bore and the head. This arrangement increases the weight in the head, increases the strength of the club, provides a more solid feel, including during the striking of a ball, and provides increased resistance to twist/torque.

Preferably, the clubhead comprises at least a pair of runners or grooves extending along the sole of the first member, rear-to-front, which guide the clubhead in the direction of the grooves if the clubhead strikes the ground. As alluded to above, the use of two members which are joined in a vertical plane permits positioning the join line at the periphery of the face and along the leading edge of the sole. This permits extended length runners, which extend preferably from the rear section of the sole to the leading edge thereof. Preferably the runners have a reverse chisel configuration defined by a relatively flat orientation at the rear which angles upwardly at the front. These runners facilitate the club's ability to track and square through the shot. Drag is reduced in the sole area. The runners which extend to the leading edge, reduce the area which strikes the ground, and allows the club to release from the initial dig into the turf.

Other embodiments and arrangements are described in the accompanying specification, including

III. BRIEF DESCRIPTION OF THE DRAWING

The present invention is described below with reference to the drawing, in which.

IV. DETAILED DESCRIPTION OF THE PREFERRED EMBODIMENT(S)

Figures 1, 2, 3:
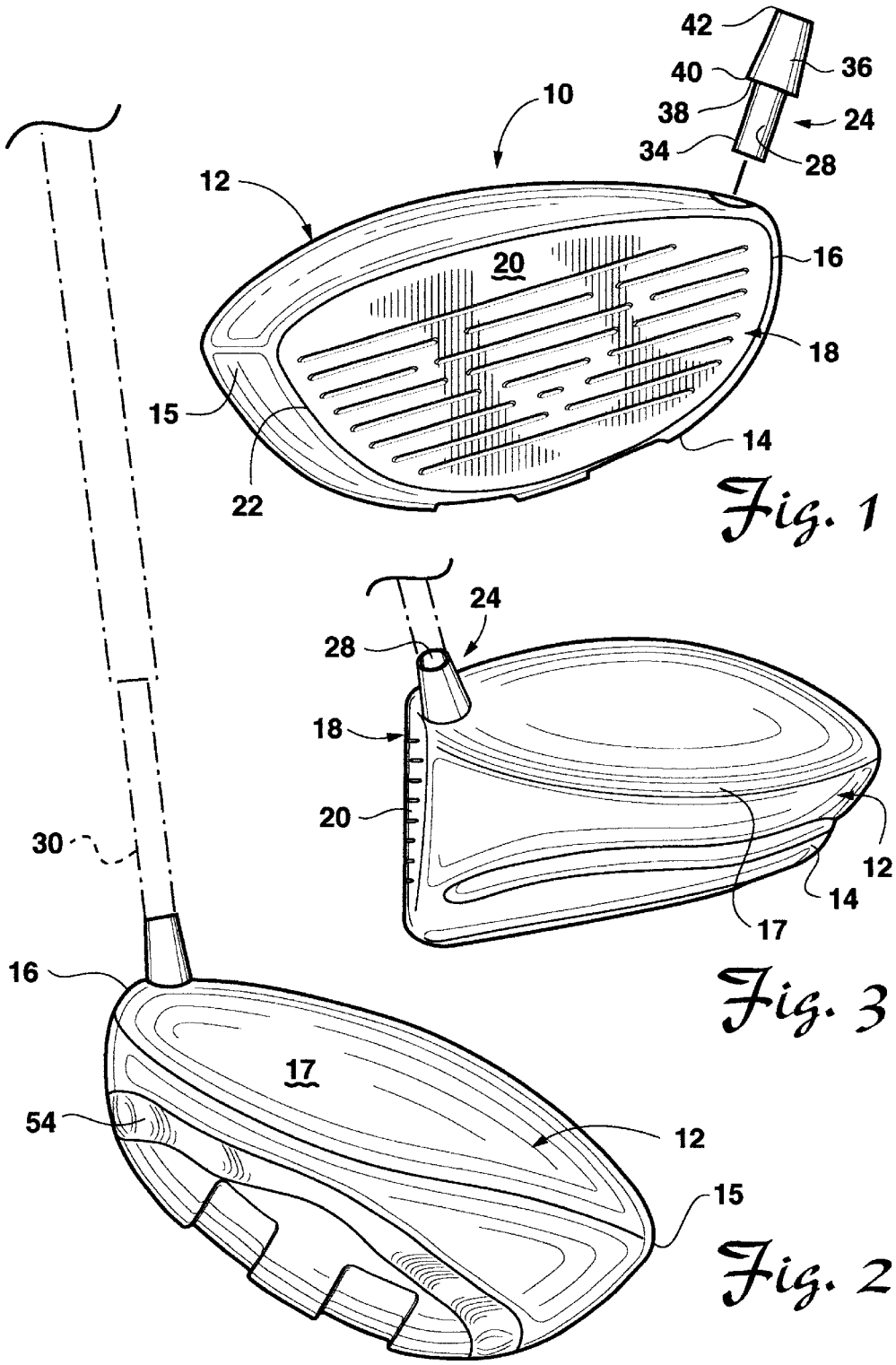
FIG. 1 is a face (front) elevation view of a metal driver in accordance with the present invention.
FIG. 2 is a heel elevation view of the metal driver of FIG. 1.
FIG. 3 is a perspective view of the driver of FIG. 1, taken generally from a rear perspective toward the heel of the clubhead.

FIG. 1 is a front (face side) elevation view of a preferred embodiment 10 of a metal driver clubhead according to the present invention. The clubhead 10 comprises a first (body) member 12 which includes sole 14, toe 15, heel 16 and rear 17 of the body of the clubhead; and a second (face) member 18 which comprises face 20 of the clubhead 10. In contrast to the prior art's horizontal joining of the soleplate to the upper body to form the clubhead, according to the present invention, the second member 18 is joined to the first member 12 along an arcuate joining line 22 in a generally vertical plane defined by the front periphery of the first member 12 and the rear periphery of the second member 18. The two members 12 and 18 are joined for example by welding along the vertical plane or joining line 22.

Figure 5:
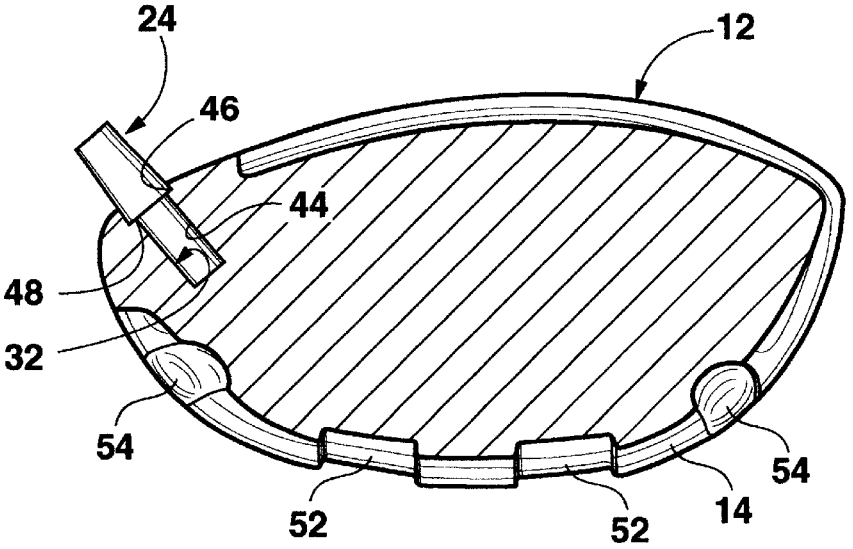
FIG. 5 is a vertical section view taken along line 5—5 in FIG. 4.

As shown most clearly in FIGS. 1 and 5, the clubhead includes a countersunk hosel 24 in the form of a stepped shaft having an internal bore 28 into which golf club shaft 30 is inserted and mounted. The first member 12 has a mating stepped bore 32 in which the hosel is mounted. Specifically, the hosel 24 comprises a lower, relatively small diameter tubular section 34 and an upper, relatively large diameter tubular section 36 which are joined by shoulder 38. The upper section 36 has a reverse taper along its length in that its diameter decreases in the outward direction (the direction away from the clubhead) and the diameter of the lower end 40 is larger than that of the upper end 42. The mating body bore 32 of the member 12, comprises a relatively small diameter lower section 44, a relatively large diameter, reverse taper upper section 46, and shoulder 48. In the present embodiment, the lower section is a right cylinder and the upper section is a tapered cylinder.

In the reverse-tapered hosel 24-bore 28 arrangement, the end 42 and the relatively narrow section (small diameter section) of the hosel adjacent the end 42 are external to the bore and to the head. The end 40 and the relatively wide section (large diameter section) of the hosel adjacent the end 40 are countersunk into and captured within the head. This arrangement both increases the weight in the head (increases the weight concentration in the head) and increases the strength of the hosel-to-shaft-to-head joinder and of the club. The result is a more solid feel, including during the striking of a ball, and increased resistance to twist/torque.

In a presently preferred embodiment, the metal head (both sections) is 17-4 stainless steel, the hosel or neck is titanium, and the shaft is graphite. Metal epoxy is used to join the head, hosel and shaft together. Other materials will be chosen by 1E those of usual skill in the art. By way of example but certainly not limitation, the shaft may be carbon steel.

Figure 4:
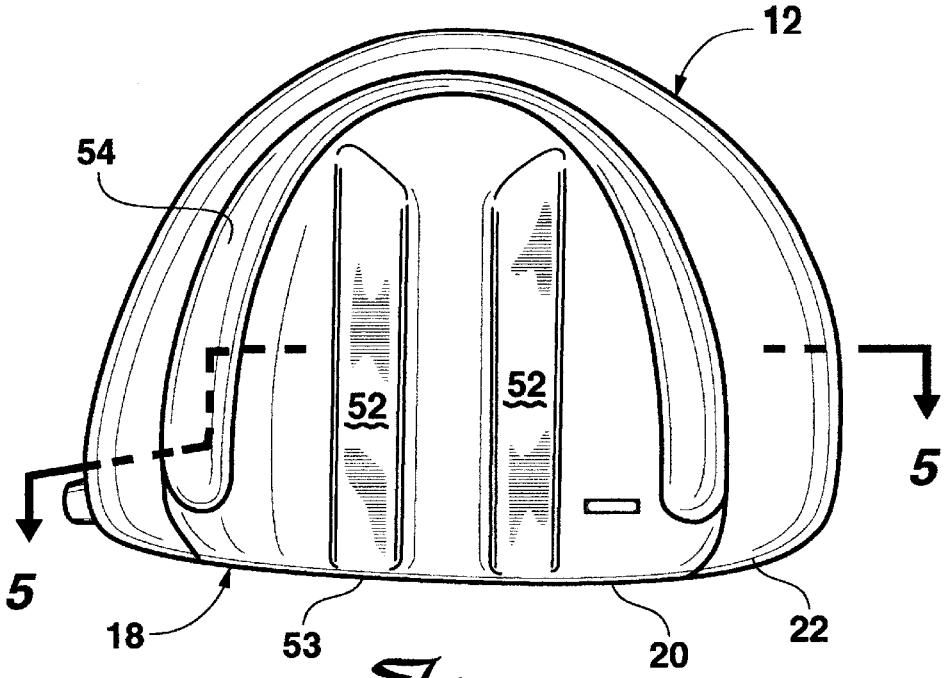
FIG. 4 is a bottom plan view of the driver of FIG. 1.

Referring now to FIGS. 2, 4 and 5, preferably the clubhead 10 comprises at least a pair of runners or grooves 52—52 which extend along the sole 14 of the first member 12, in a rear-to-front direction. As alluded to above, the use of the two members 12 and 18 joined in a vertical plane permits the use of a member 18 which comprises substantially only the face 20 of the club and permits positioning the vertical join line 22 just behind the face. In contrast to the prior art joining line, which would interfere with and limit forward extension of any runners, the vertical joining line 22 permits the use of extended, continuous, long runners 52—52 which reach to the leading edge 53 at the face of the clubhead. As shown in FIGS. 4 and 5, preferably the runners have a reverse chisel configuration defined by a relatively flat orientation at the rear which angles upwardly at the front.

The extended length, reverse chisel runners facilitate the club's ability to track and square through the shot. Drag is reduced in the sole area. In prior art clubheads, normally the lower leading edge strikes the ground. In my club, the use of runners which extend to the leading edge, reduces the area which strikes the ground, and allows the club to release from the initial dig into the turf.

In another aspect, a C-shaped groove 54 is formed around the periphery of the clubhead sole 14, with ends terminating at the front of the body member 12 adjacent the joining line 22/sole leading edge 53. The groove 54 is both cosmetic and functional, in that it is thought to impart a heavier, directed wind tunnel-generated appearance, and in that it permits the sole plate 14 to extend lower, lowering the center of gravity.

To assemble the driver, the two members 12 and 18 are welded together along joining line 22. The hosel 24 is inserted into the body bore 32 and epoxy is inserted into the bore. While the epoxy is fresh (before it cures), the club shaft 30 is inserted into the hosel, thereby mixing the epoxy between the shaft, hosel and head, and enhancing the strength of the joinder of the shaft and the hosel to one another and to the clubhead.

Having thus described preferred and alternative embodiments of the present invention, those of usual skill in the art will readily derive modifications and extensions within the scope of this invention and limited only by the extent of the present claims.

What is claimed is:

1. A metal driver clubhead, comprising: a first member forming the body of the clubhead and comprising sole, toe, heel and rear sections thereof; a second member comprising a face section of the clubhead; the first member and the second member being joined along a generally vertical plane behind and proximate the face section; a joining medium securing the first and second members together; a hosel comprising a section having a reverse exterior taper forming relatively small and relatively large ends and further comprising an internal bore into which a golf club shaft is inserted; the first member comprising a reverse tapered bore capturing the large end of the reverse tapered hosel, with the reverse exterior taper of the hosel mating against the reverse tapered body bore, thereby locking the hosel inside the bore.

2. The metal driver clubhead of claim 1, further comprising at least a pair of grooves extending in a rear-to-front direction along the sole of the first member to a leading edge of the sole.

3. The metal driver clubhead of claim 2, wherein the first member includes a front edge and the sole extends to the front edge, and wherein the clubhead further comprises a C-shaped groove extending about the periphery of the sole and having ends thereof terminating adjacent the front edge.

4. The metal driver of claim 1, wherein the hosel is stepped and comprises a lower, relatively small diameter cylindrical section and an upper, relatively large diameter cylindrical section separated by a shoulder; the upper cylindrical section of the hosel having a reverse taper along its length formed by the diameter of the hosel decreasing in the direction away from the clubhead such that the diameter of an upper end thereof is smaller than the diameter of a lower enlayed end thereof; the mating body bore comprising a relatively small diameter cylindrical lower section and a relatively large diameter, reverse taper cylindrical upper section separated by a shoulder; and the diameter of the bore being approximately the same dimension or slightly larger than the diameter of the corresponding sections of the hosel, so that insertion of the hosel captures both the lower section of the hosel and the enlarged end of the reverse tapered upper section of the hosel.

5. The metal driver clubhead of claim 4, further comprising at least a pair of grooves extending in a rear-to-front direction along the sole of the first member to a leading edge of the sole.

6. The metal driver clubhead of claim 5, wherein the first member includes a front edge and the sole extends to the front edge, and wherein the clubhead further comprises a C-shaped groove extending about the periphery of the sole and having ends thereof terminating adjacent the front edge.

* * * * *